US007635031B2

(12) United States Patent
Davison

(10) Patent No.: US 7,635,031 B2
(45) Date of Patent: Dec. 22, 2009

(54) APPARATUS AND METHOD FOR INSTALLING A SUCKER ROD GUIDE

(75) Inventor: Matthew S. Davison, Yukon, OR (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 43 days.

(21) Appl. No.: 12/113,429

(22) Filed: May 1, 2008

(65) Prior Publication Data

US 2008/0271897 A1 Nov. 6, 2008

Related U.S. Application Data

(60) Provisional application No. 60/927,450, filed on May 3, 2007.

(51) Int. Cl.
*E21B 19/00* (2006.01)

(52) U.S. Cl. ..... 166/379; 166/241.4; 166/380; 166/85.1; 285/123.1

(58) Field of Classification Search ..... 166/85.1, 166/241.4, 379, 380; 285/123.1
See application file for complete search history.

(56) References Cited

U.S. PATENT DOCUMENTS

| | | | | |
|---|---|---|---|---|
| 5,282,302 | A * | 2/1994 | Starks et al. | 29/268 |
| 5,358,041 | A | 10/1994 | O'Hair | |
| 5,430,919 | A * | 7/1995 | Starks et al. | 29/252 |
| 7,325,619 | B2 * | 2/2008 | Morrison | 166/380 |
| 2006/0137885 | A1 | 6/2006 | Morrison | |

* cited by examiner

*Primary Examiner*—Jennifer H Gay
*Assistant Examiner*—Blake Michener
(74) *Attorney, Agent, or Firm*—Browning Bushman P.C.

(57) ABSTRACT

A fluid powered tool is disclosed for assembling a two piece guide on a sucker rod at a well site. The tool includes a table (26) laterally moveable with respect to the sucker rod and supporting a fluid powered cylinder (28), a bottom plate (42) for engaging the rod guide, and a top plate (56) also for engaging the rod guide. At least one vertical guide (30) is provided for guiding vertical movement of at least one of the bottom plate and top plate, and a horizontal rail (32) is provided for guiding lateral movement of the table. Each of the top plate and the bottom plate include a recess for receiving the sucker rod when engaged by the guide. The fluid powered cylinder moves the bottom plate with respect to the top plate to assembly the guide on the rod.

20 Claims, 13 Drawing Sheets

APPARATUS AND METHOD FOR INSTALLING A SUCKER ROD GUIDE

CROSS REFERENCE TO RELATED APPLICATIONS

This application claims priority from U.S. Patent Application Ser. No. 60/927,450, filed May 3, 2007 for an APPARATUS AND METHOD FOR INSTALLING A SUCKER ROD GUIDE, which is incorporated herein in its entirety for all purposes.

FIELD OF THE INVENTION

The present invention relates to tools and equipment for installing a guide on a sucker rod. More particularly, the invention relates to a powered tool for axially moving a first rod guide component relative to a second rod guide component to assemble the guide on a sucker rod.

BACKGROUND OF THE INVENTION

Sucker rods are commonly used in oilfield operations to power a downhole pump in a well, thereby pumping downhole fluids to the surface. The pumped fluids may be oil or other hydrocarbons, or may be water which is removed from the well so that gas production may be increased. Sucker rods of this type may be reciprocated to power the downhole pump or alternatively may be rotated. In either event, rod guides have conventionally been used on sucker rods to minimize wear on the tubing string by preventing the sucker rod from contacting the tubing string, thereby enhancing the useful life of the well.

Various types of rod guides have been devised, and various types of tools have been used for installing guides on sucker rods. Many rod guides are of the type which have a substantially unitary body with a C-shaped cross-sectional configuration, so that a slot in the guide is spread apart to laterally position the guide on the sucker rod. A sucker rod guide installation device for a single piece sucker rod guide is disclosed in U.S. 2006/0137885A1. Two piece rod guides of the type disclosed in U.S. Pat. No. 5,358,041 have been assembled on a sucker rod utilizing an operator powered lever tool. The time and difficulty associated with assembling a guide by this technique can be a significant deterrent to use of such a guide.

The disadvantages of the prior art are overcome by the present invention, and an improved method and apparatus for installing a two-piece guide on a sucker rod are hereinafter disclosed.

SUMMARY OF THE INVENTION

In one embodiment of the invention, a fluid powered tool for assembling a two piece guide on a sucker rod at a well site comprises a table laterally movable with respect to the sucker rod, with the table supporting a fluid powered cylinder, a bottom plate for engaging the rod guide, a top plate for engaging the rod guide, and a vertical rail for guiding the vertical movement of one or more of the bottom plate and the top plate. The tool further includes at least one horizontal rail for guiding lateral movement of the table. Each of the top plate and the bottom plate containing a recess for receiving the sucker rod when the guide engages the respective plate. The fluid powered cylinder moves the bottom plate with respect to the top plate to assemble the guide on the rod.

According to one embodiment of the method of the invention, the two piece rod guide is assembled on a sucker rod by supporting a fluid powered cylinder, a bottom plate, a top plate, and one or more vertical guides on a table. The table is guided for lateral movement by one or more horizontal rails. A recess is formed in each of the bottom plate and the top plate for receiving the sucker rod when the guide engages a respective plate. A bottom plate is moved axially with respect to the top plate to assembly the guide on the sucker rod.

DETAILED DESCRIPTION OF PREFERRED EMBODIMENTS

Figure 1:
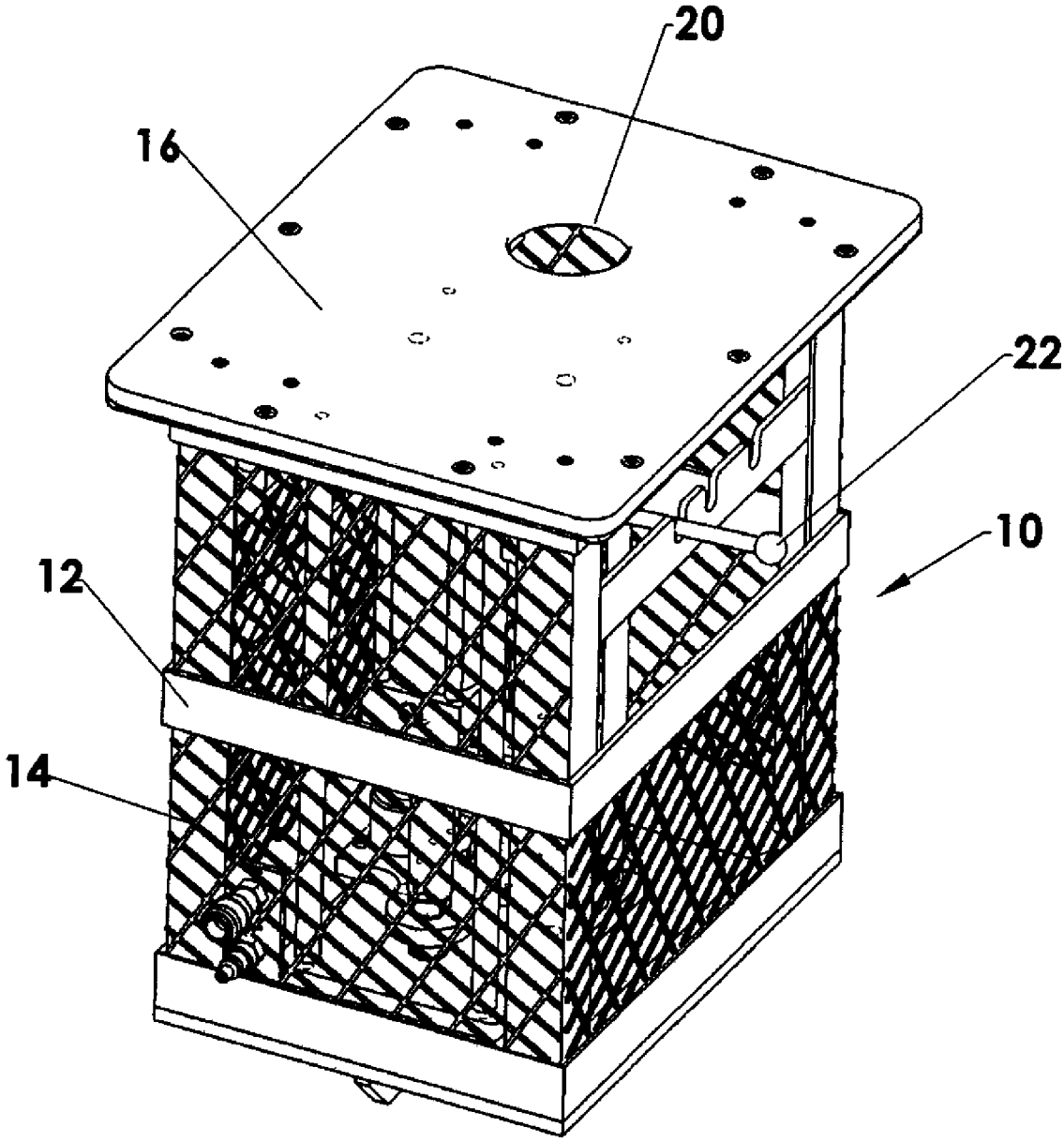
FIG. 1 is a pictorial view of a hydraulically powered insulation tool according to the present invention.

FIG. 1 illustrates a hydraulic installation tool 10 according to the present invention for assembling a two-piece rod guide on a sucker rod at a well site. The installation tool comprises a frame 12 with a screen 14 extending between vertical frame components. A top plate 16 and a bottom plate 18 are each provided with a opening 20 for receiving a sucker rod therein. FIG. 1 also depicts a lever 22 which is manually operable between a first position as shown in FIG. 1 to an intermediate or second position, and to a third or active position. A lower threaded nipple 24 is shown in FIG. 2 for threading the assembly to the top of a wellhead or other suitable structure.

Figure 2:
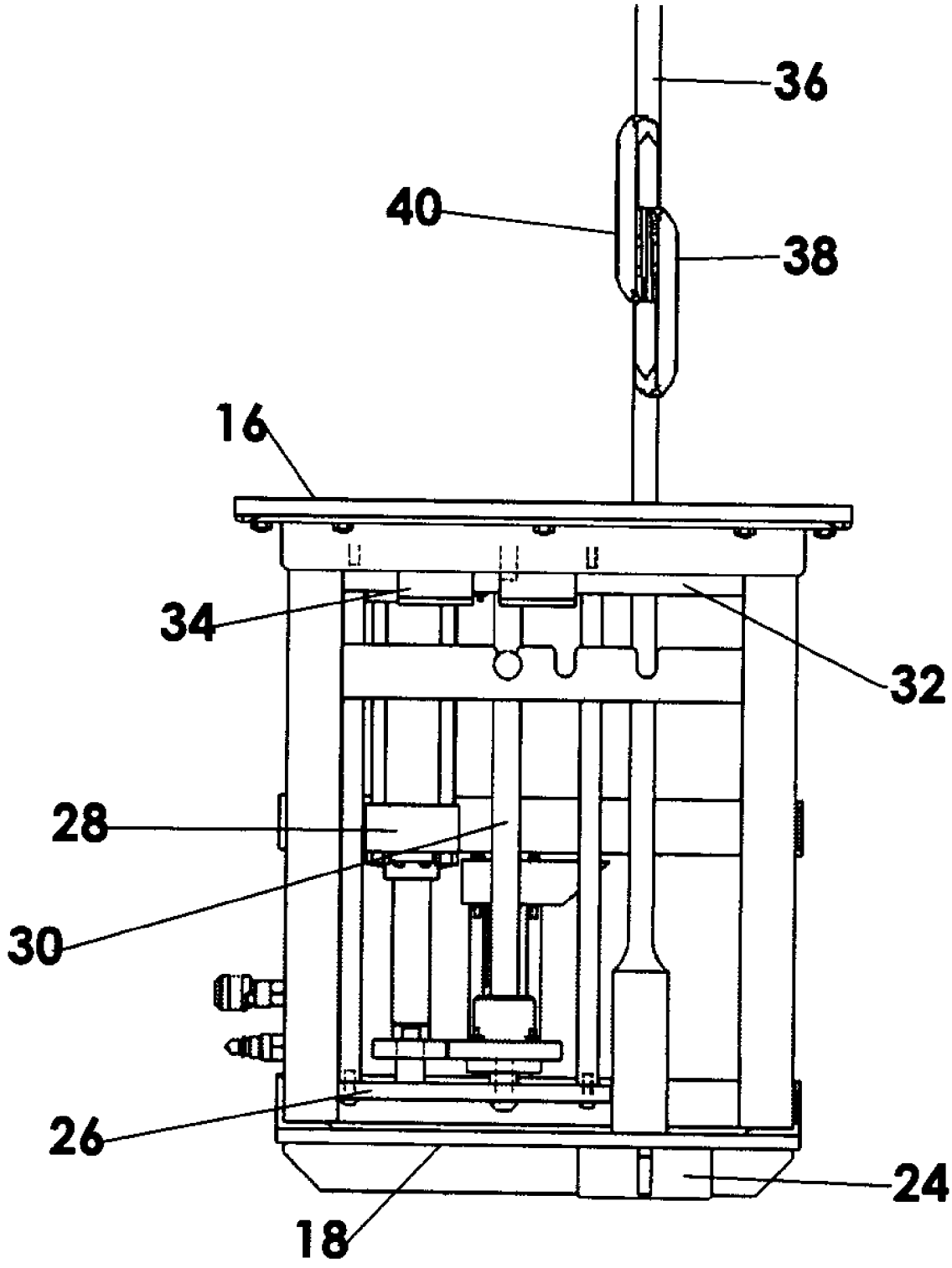
FIG. 2 is a front view of the installation tool, with a hydraulic actuating mechanism in a first default position and a two-piece guide partially assembled on the rod above the installation tool.

Referring to FIG. 2, the assembly includes a laterally movable table 26 including hydraulic cylinder 28 and vertical support 30. More particularly, the table is laterally movable along the horizontal axis of rail 32, with a pair of bearing members 34 desirably providing a guiding function for easily moving the table laterally (horizontally) by moving the lever arm 22. Preferably a pair of spaced apart rails are provided for this purpose, with each rail having a pair of bearing members. FIG. 2 also illustrates a portion of a sucker rod 36 with rod guide components 38 and 40 partially assembled and positioned on the rod 36. As more fully disclosed below, the installation tool 10 acts to axially move the components 38 and 40 together, so that the rod guide is fully assembled on the rod 36 while the rod extends down into the well.

Figure 3:
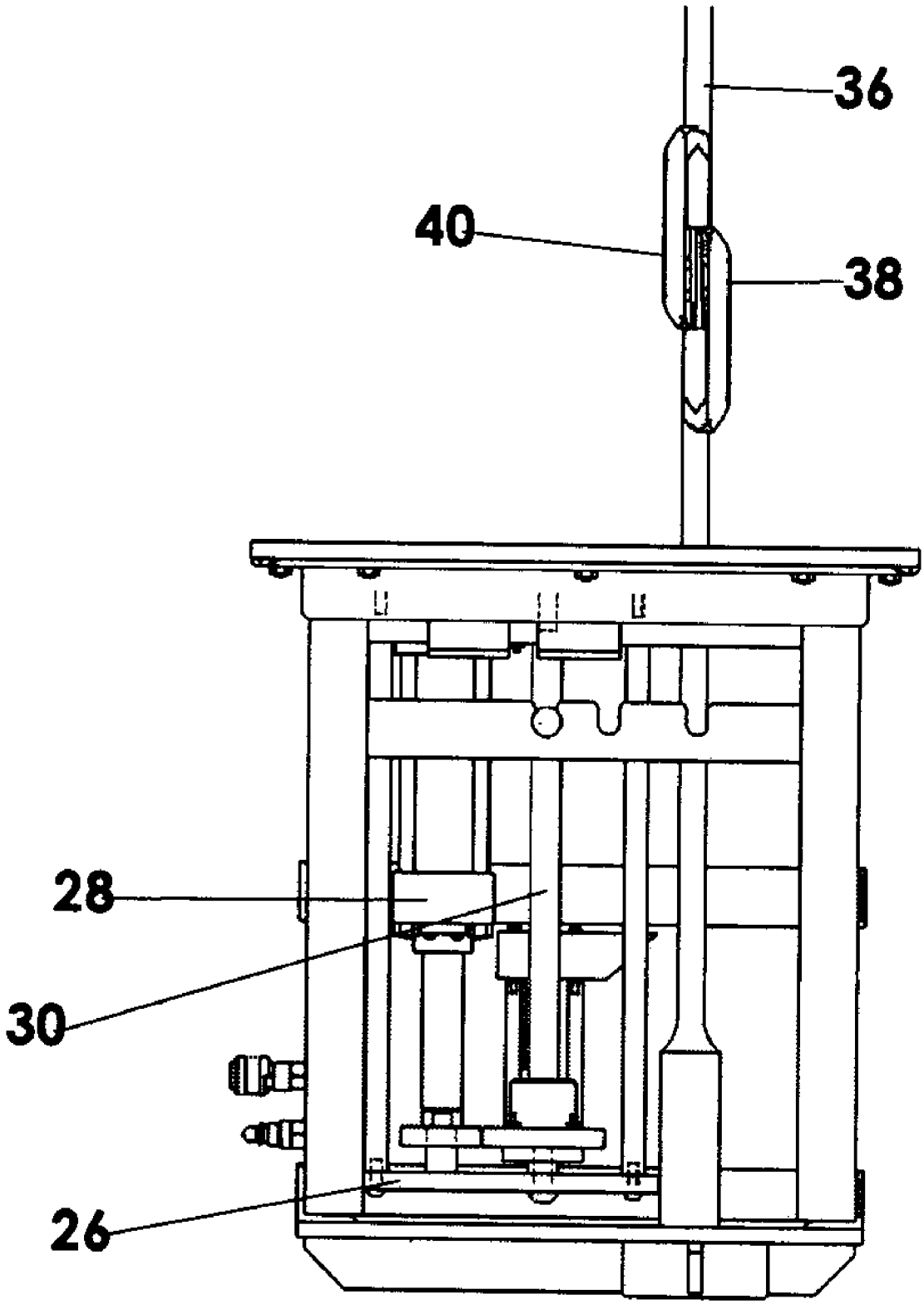
FIG. 3 is a front view of the installation tool, wherein an operating lever has been moved to an intermediate or second position so that the hydraulic actuating mechanism is also in the second position.
Figure 4:
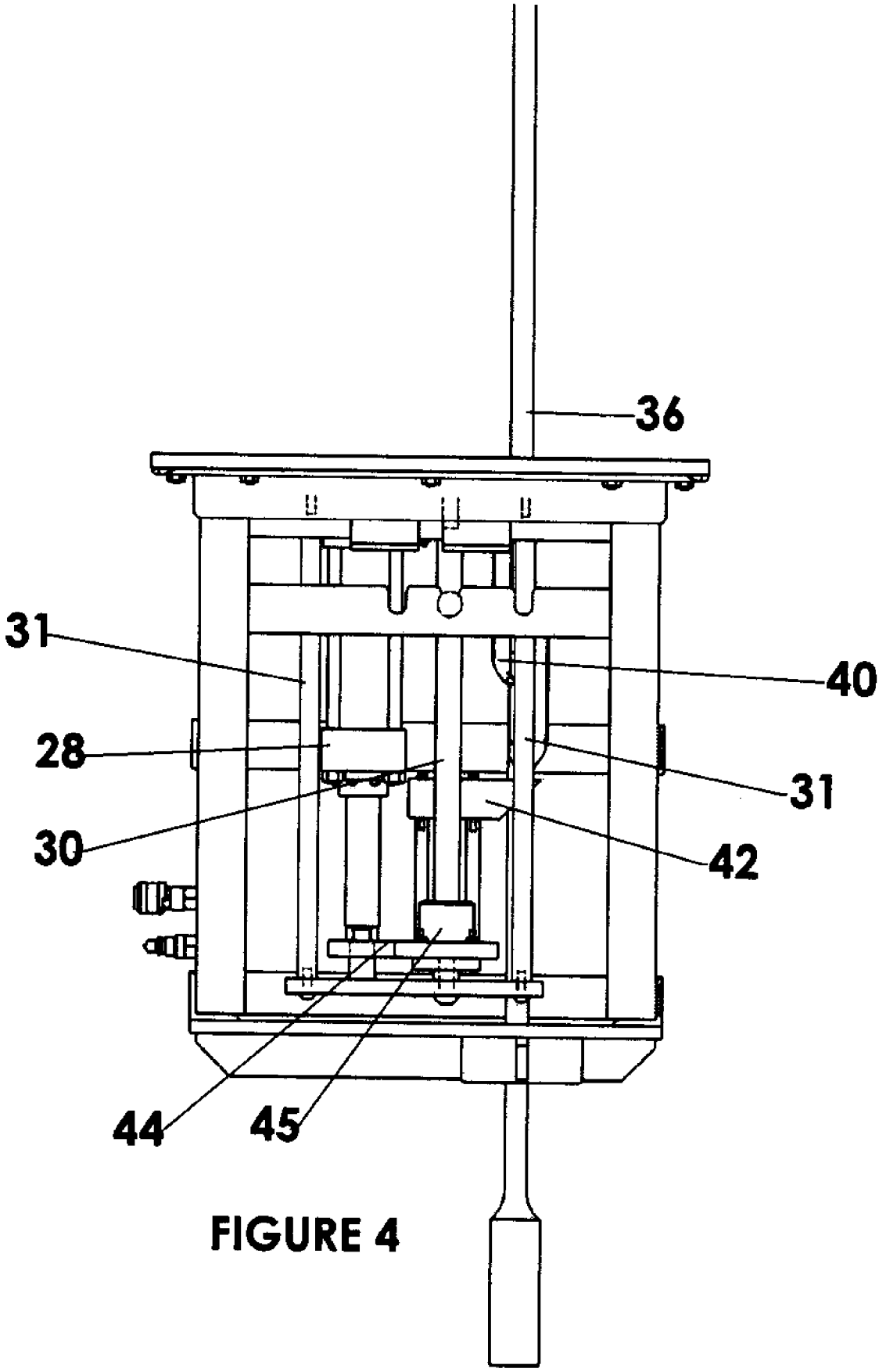
FIG. 4 is a front view of the installation tool, with the rod string lowered until the guide hits a tag plate.
Figure 5:
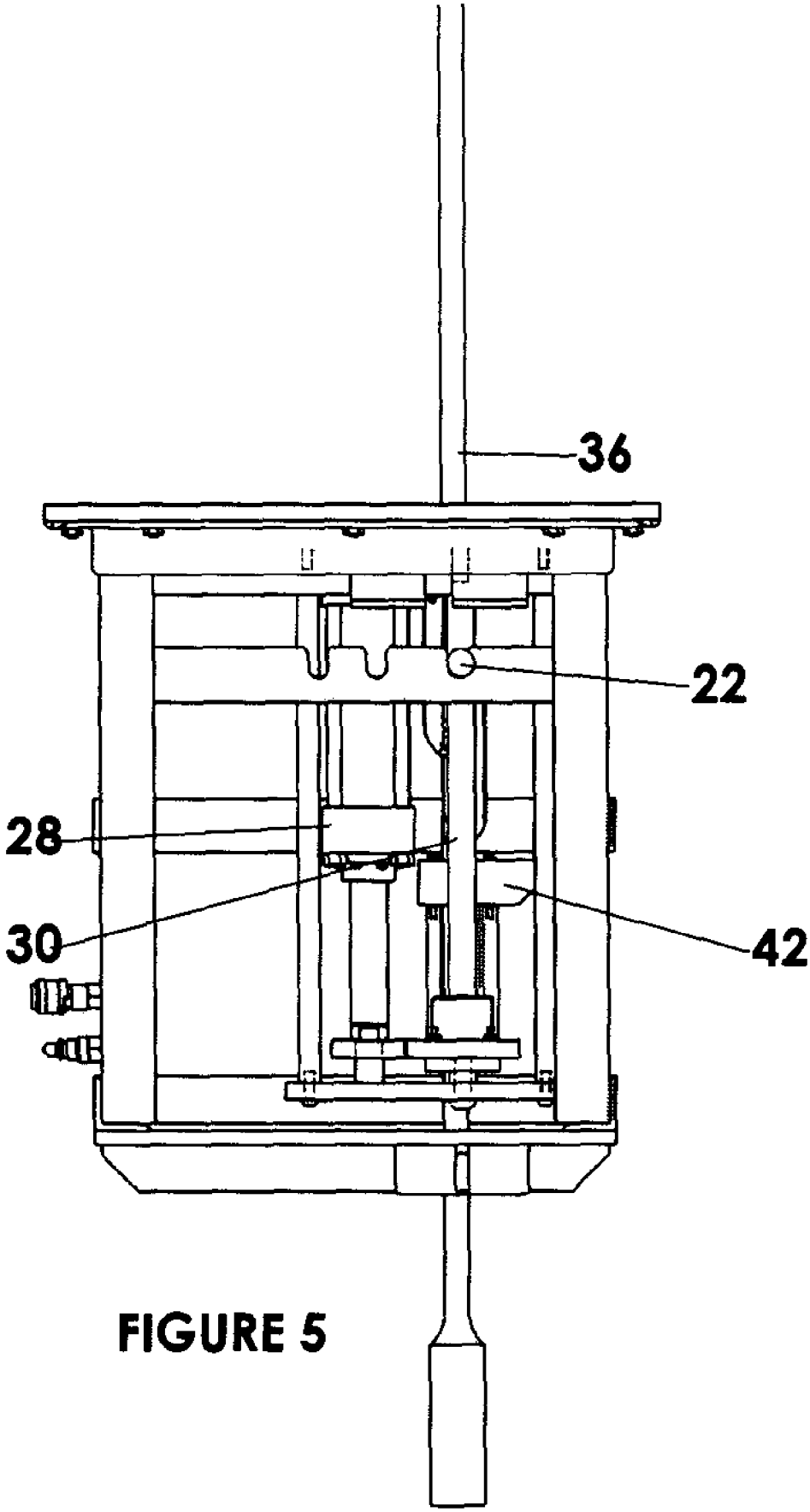
FIG. 5 is a front view of the installation tool, with the lever moved to a third position, so that the table is in the third or active position.
Figure 6:
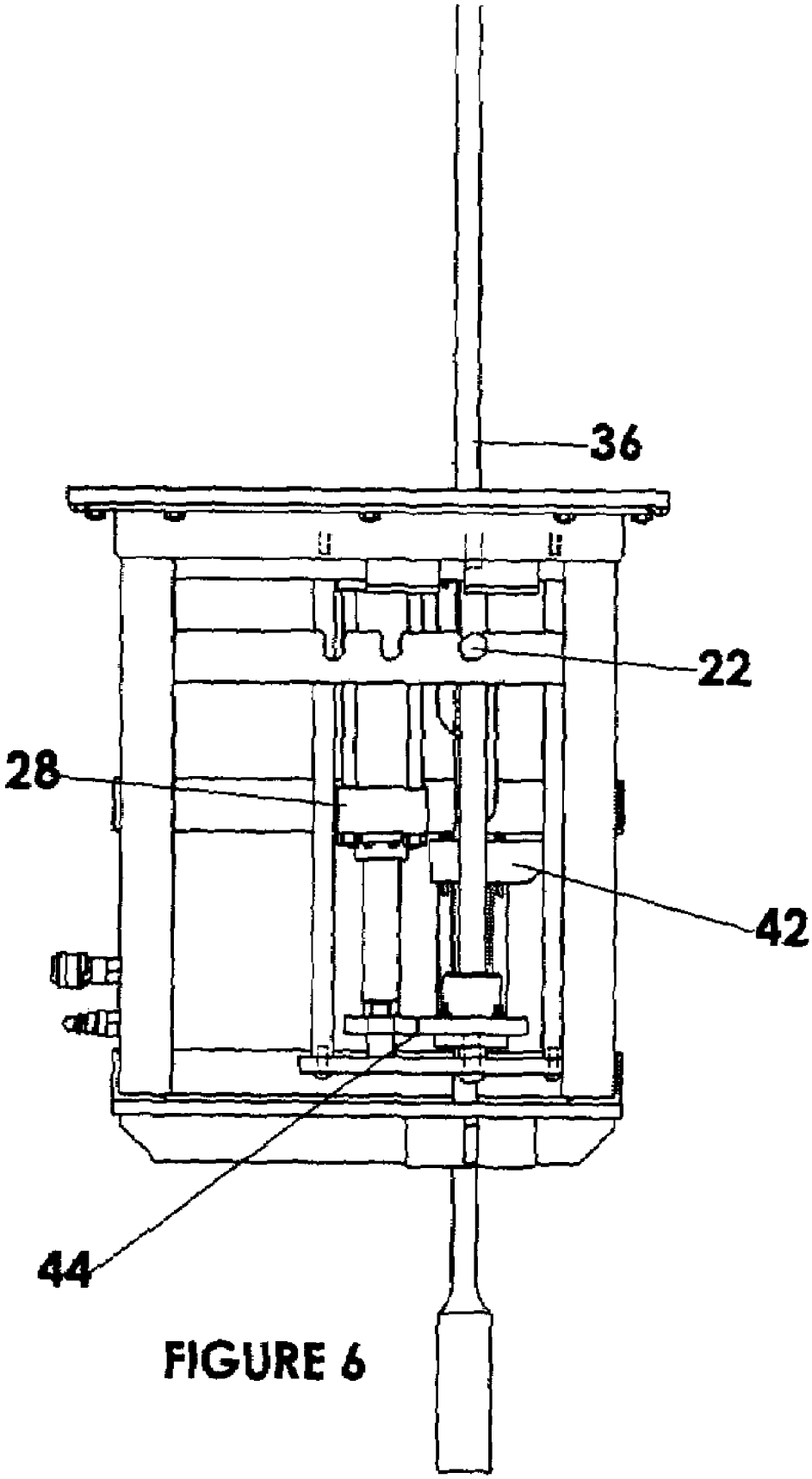
FIG. 6 is a front view of the installation tool, with the cylinder activated to assemble the guide on the rod.
Figure 7:
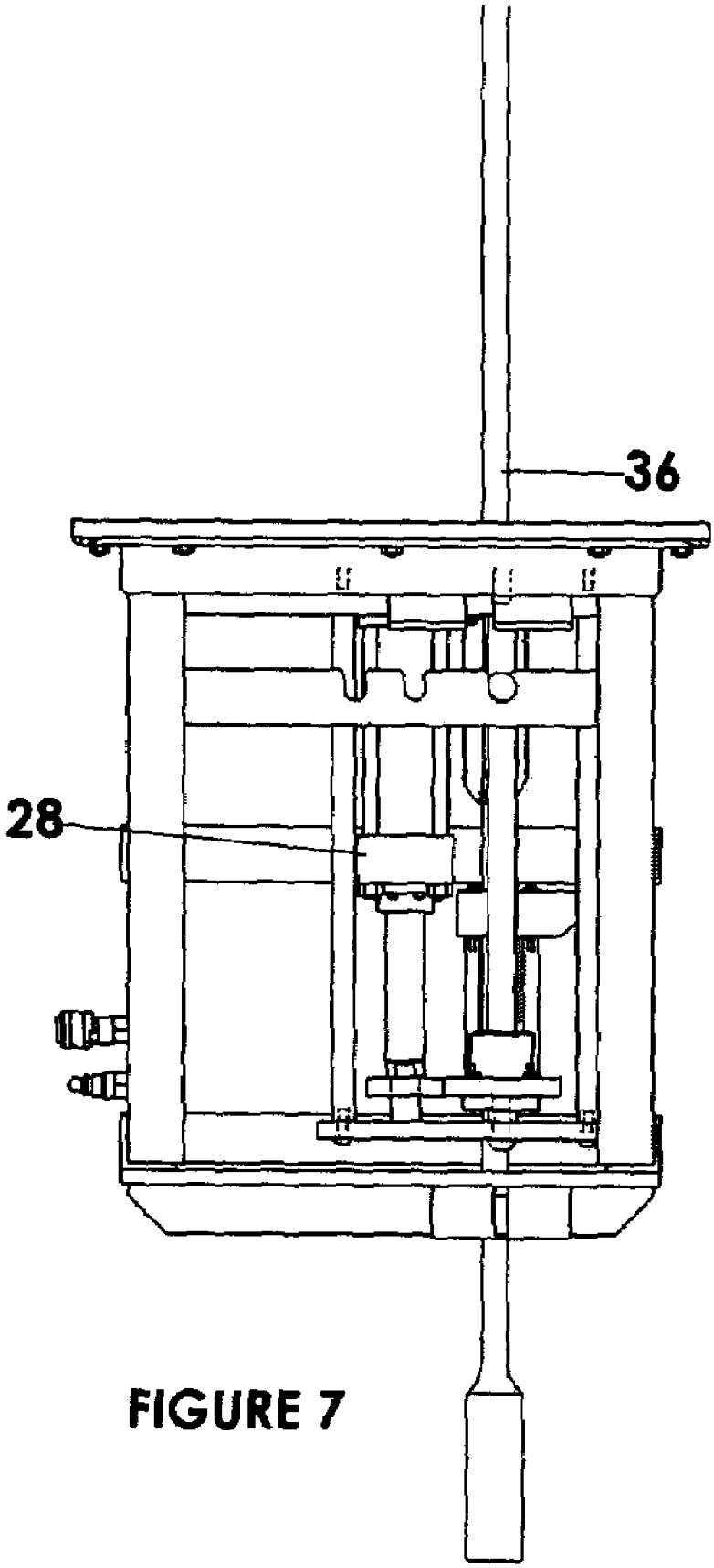
FIG. 7 is a front view of the installation tool, with the cylinder opened.
Figure 11:
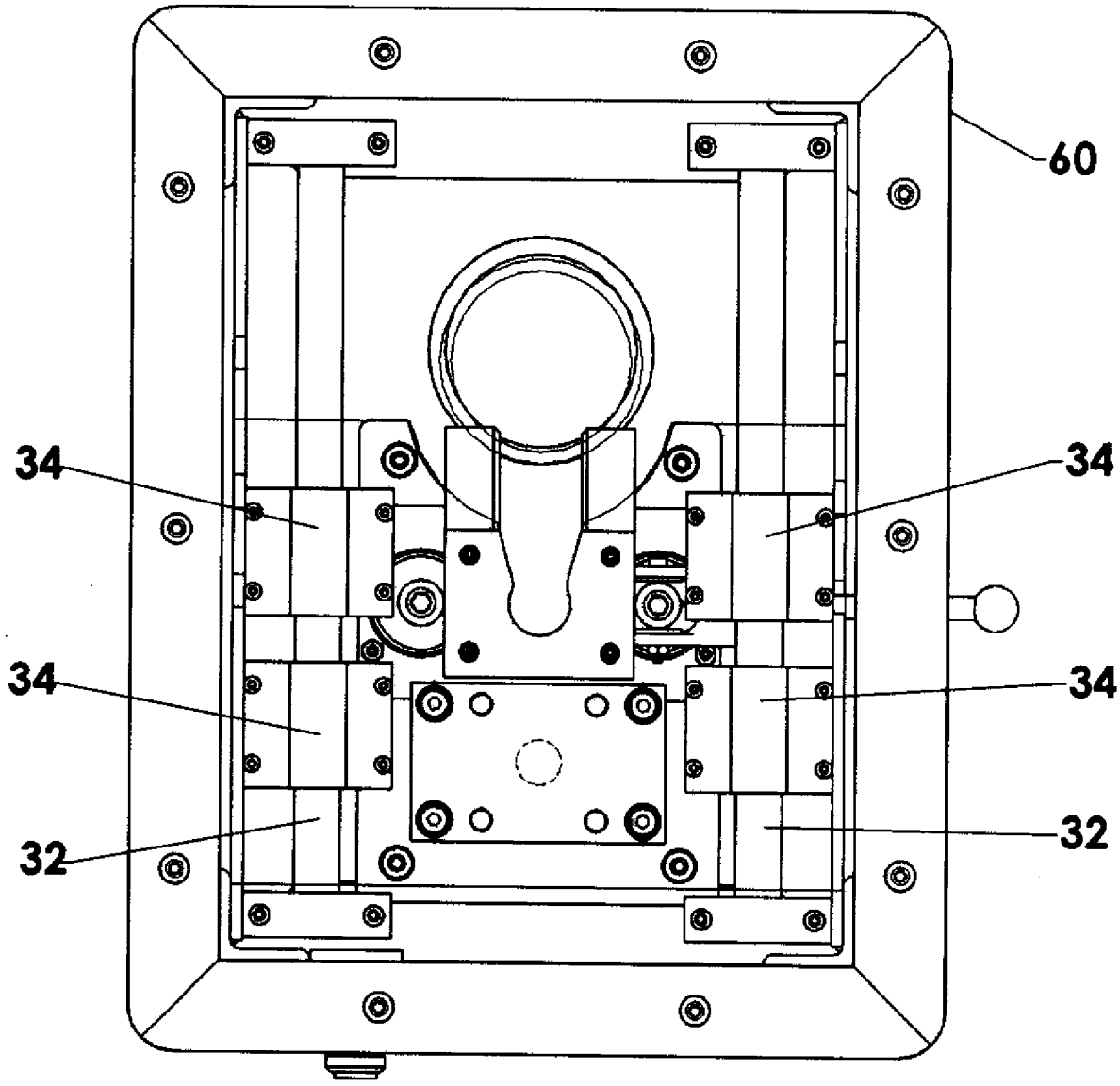
FIG. 11 is a top view of the bottom plate or tag plate in the intermediate position for engaging the lower portion of the rod guide.
Figure 12:
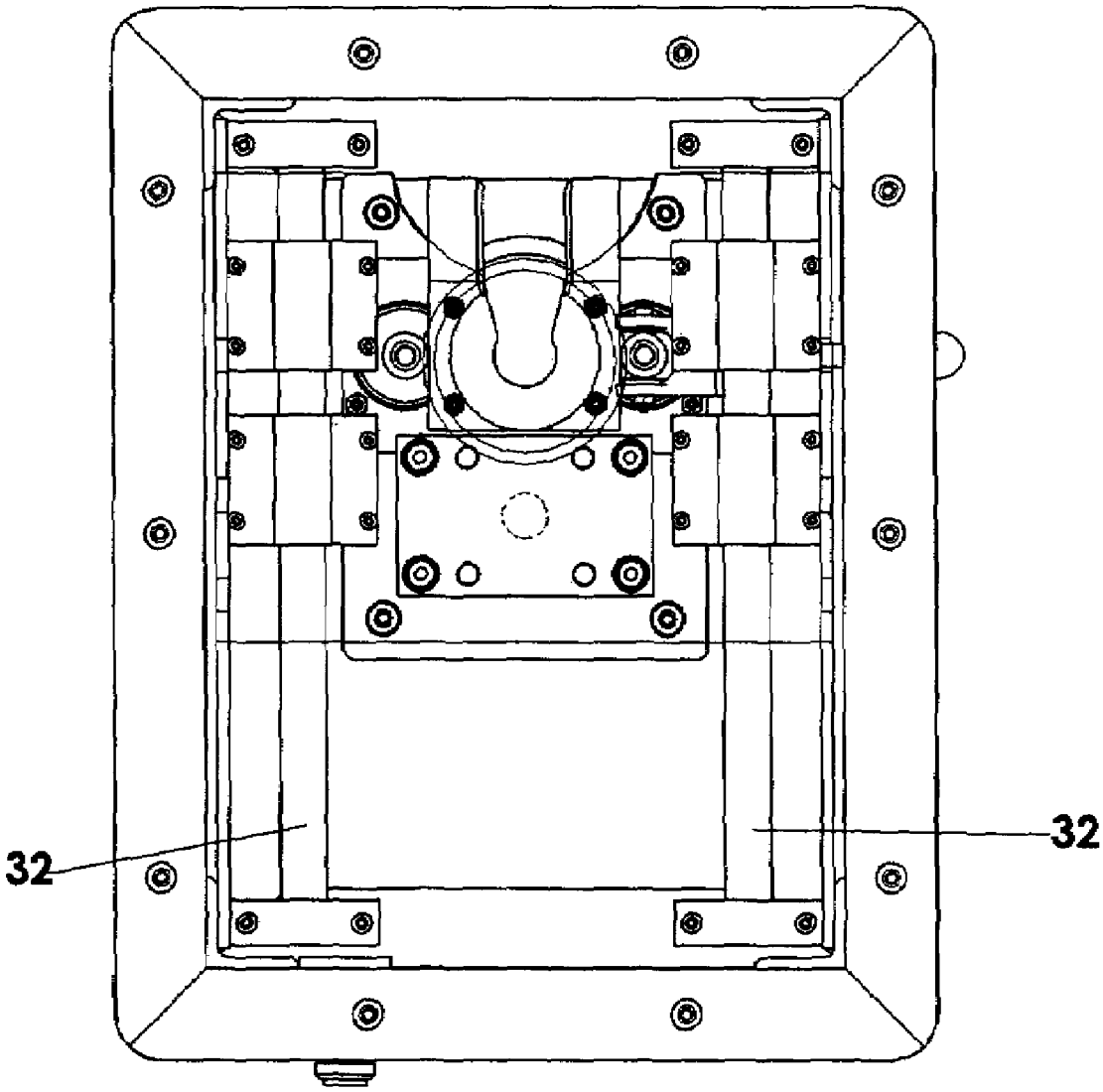
FIG. 12 is a top view of a bottom plate in the active position for assembling the rod guide.
Figure 13:
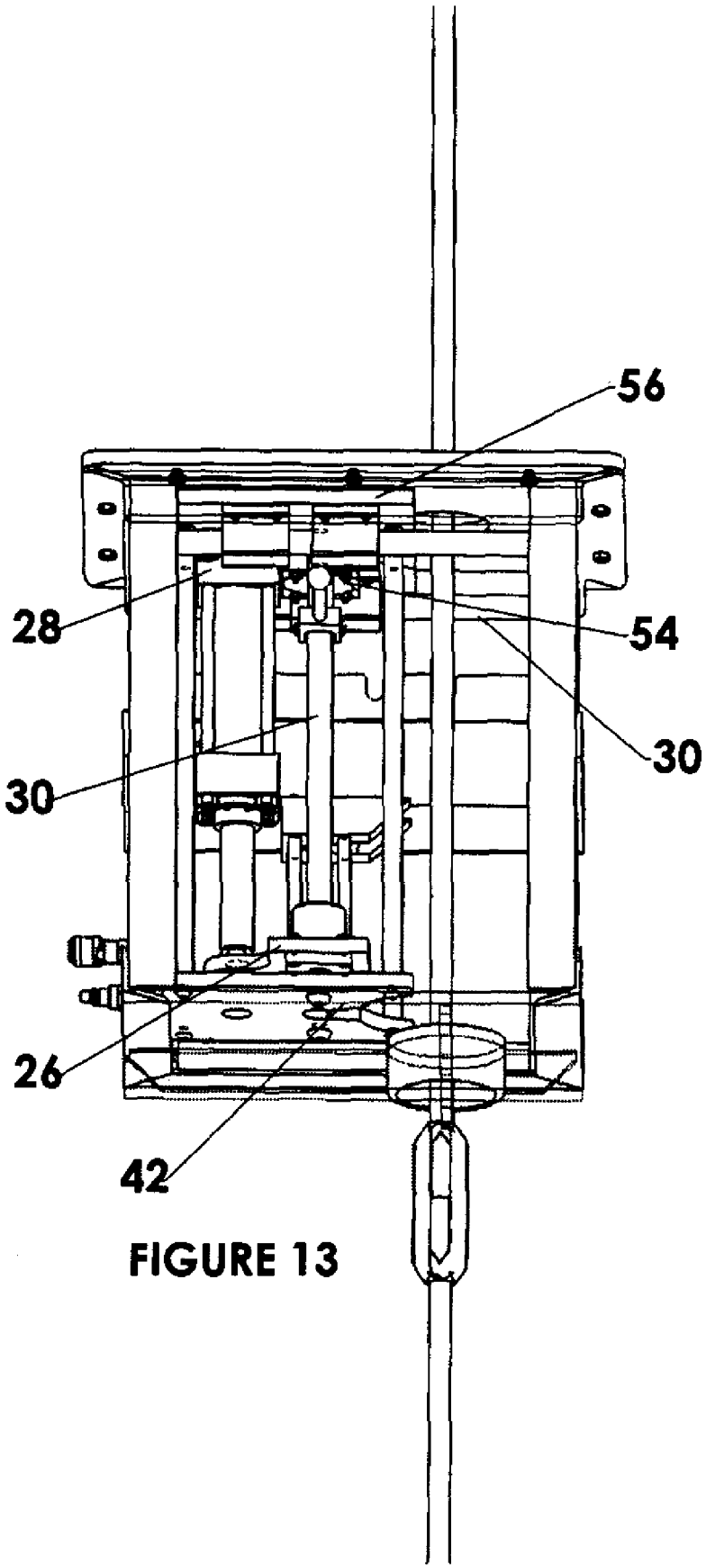
FIG. 13 is a pictorial view of the installation tool, showing the bottom of the top plate in the active position for assembling the rod guide.

In FIG. 3, the lever or handle 22 has been activated to move the table and thus the cylinder 28 and the vertical guide 30 to an intermediate position closer to the rod string 36. In FIG. 4, the rod string is then lowered until component 40 of the rod guide engages the top of tag plate 42 of the table, which is supported on a connecting plate 44 between the cylinder 28 and the vertical guide. Engagement of the guide with the tag plate 42 when in the intermediate position is shown in FIG. 11. In FIG. 5, the lever 22 is again activated until the table is moved to the third or activated position. In this position, the lower component 40 of the rod guide engages the surface of a frustoconical opening 52 in the bottom plate 42, as shown in FIG. 12, thereby maintaining the lower portion of the rod guide centered with respect to the axis of the rod. As shown in FIG. 6, the cylinder 28 may then be activated to raise the tag plate 42, thereby moving the lower half 40 of the rod guide axially into engagement with the upper half 38 of the rod guide. As the lower portion 40 of the guide moves upward, the upper portion 38 of the guide is prevented from continuing to move upward since the upper portion of the guide engages the frustoconical opening 54 in the upper plate 56, as shown in FIG. 13. Upward movement of the tag plate 42 in response to activation of the cylinder 28 thus moves the lower portion of the rod guide axially upward until the rod guide is fully assembled on the rod. FIG. 7 depicts the cylinder 28 opened with the rod guide fully assembled on the sucker rod 36.

Figure 8:
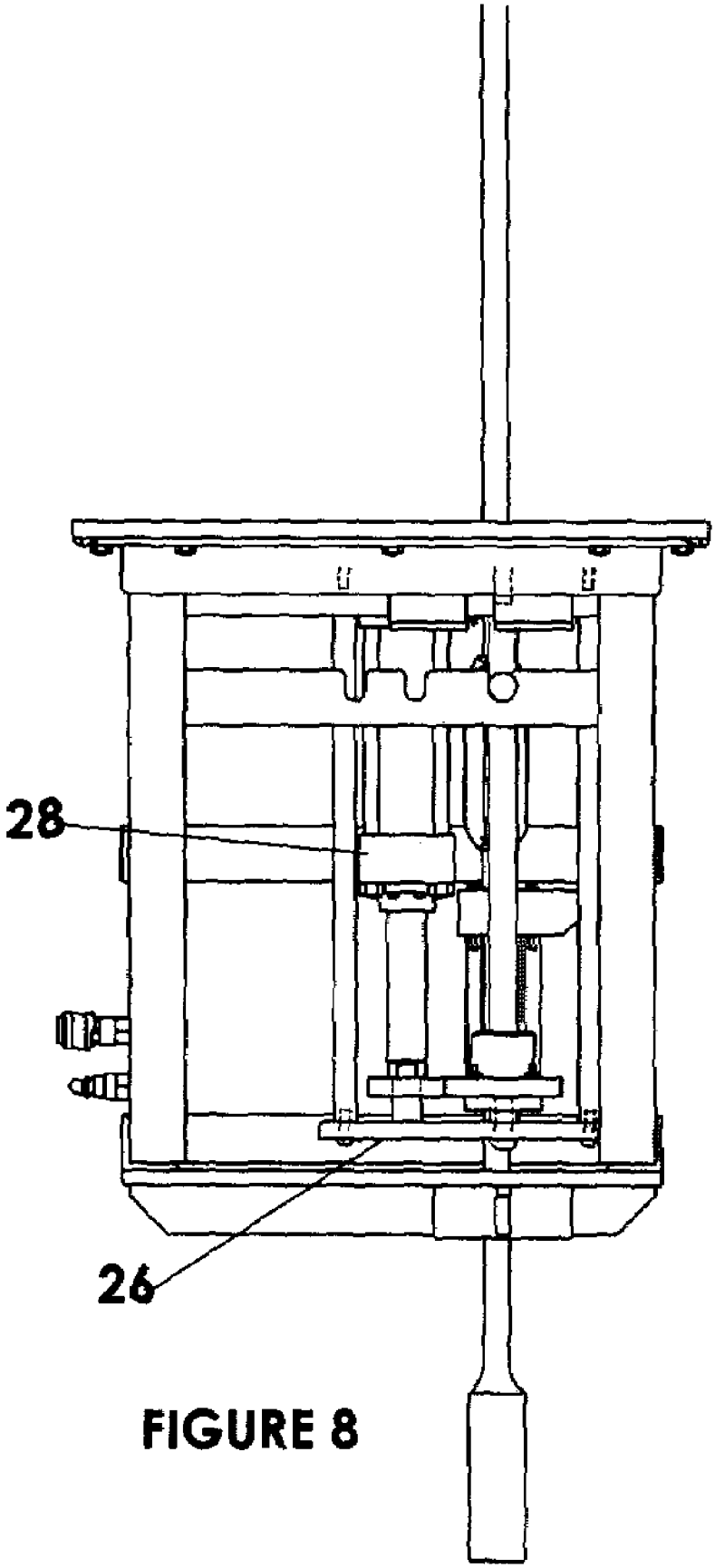
FIG. 8 is a front view of the installation tool, with the rod string lowered slightly to clear the top of the installation tool.
Figure 9:
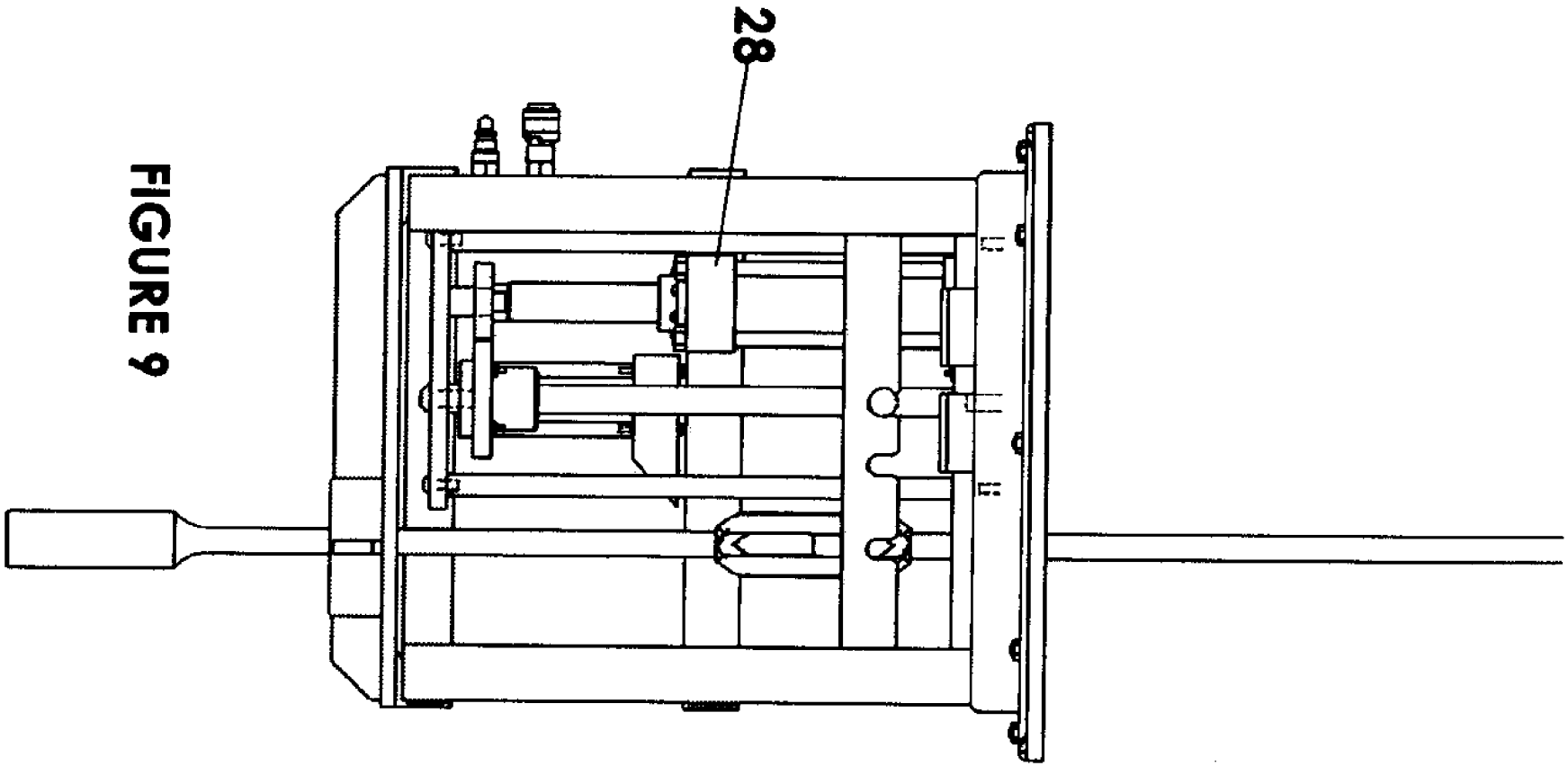
FIG. 9 is a front view of the installation tool, with the lever moved back to the first position so that the table is again in the first position.
Figure 10:
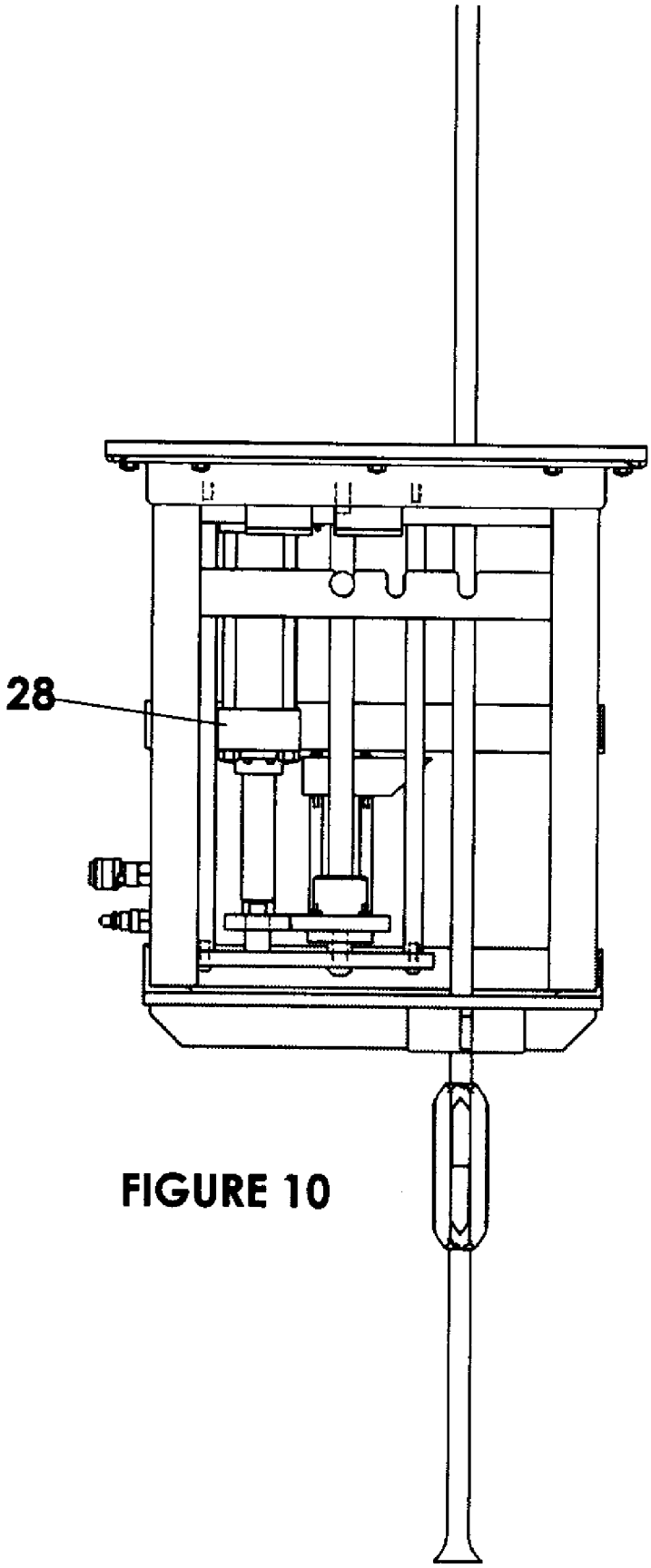
FIG. 10 is a front view of the installation tool, with the rod string lowered below the installation tool.

To finish the installation, the rod string may be slightly lowered, as shown in FIG. 8, so that it will not interfere with movement of the table 26, and the table may then be moved back to the first or default position, as shown in FIG. 9. In FIG. 10, the rod string is lowered downhole past the installation device 10. The process may then be repeated for each rod guide assembled on the string.

FIG. 11 illustrates a top view of the installation tool, with the top plate 16 and the upper plate 56 of the table removed for clarity of the tag plate or bottom plate 42. FIGS. 11, 12, and 13 also depict the pair of spaced apart rails 32 and the bearing members discussed above. It should be understood that in a preferred embodiment, the frame 60 of the insulation tool may remain substantially stationary with respect to the rod string, and the components supported on the table move laterally between the first, second, and third positions. Thus it should be understood that when the table is in the first or inactive position, the frame 60 will be generally positioned as shown on FIG. 11 with respect to the sucker rod, but the component supported on the rails 32 will be to the right of the intermediate position shown in FIG. 11. In this intermediate position, it should be understood that the lower portion of the rod guide will thus engage the tag or bottom plate 42, thereby serving as a stop to prevent further downward movement of the rod guide with the string. In the third or active position, as shown in FIG. 12, the table and its supported components have been moved to the left from the position as shown in FIG. 11, so that the rod and the rod guide are thus now positioned within the frustoconical opening 52 in the plate 42, thereby serving to maintain the lower portion of the rod guide centered with respect to the rod when the cylinder 28 is activated to move the lower plate upward and thus assemble the guide on the sucker rod.

FIG. 13 is a simplified pictorial view of the rod guide assembly with some components removed for clarity. Most importantly, FIG. 13 illustrates the frustoconical surface 54 in the upper plate 56, so that the upper portion 38 of the rod guide engages this frustoconical surface on the upper plate 56 to stop upward movement of the rod guide as the cylinder 28 is activated to move the lower portion of the rod guide upward and assemble the guide on the rod.

In a preferred embodiment, a plurality of spaced apart horizontal guide rails 30 are provided for guiding movement of the lower plate in response to activation of the cylinder 28 as it moves upward. In a preferred embodiment, four vertical guide rails are attached to the connecting plate 26, and serve to guide movement of the tag plate 42 as it moves upward in response to activation of the cylinder 28.

The installation tool as described herein presents a significant advancement over manually operated tools, both in terms of the time required to install a guide on a sucker rod, and the risks associated with that installation.

A hydraulically powered tool is preferred for many applications, but a pneumatically powered tool could be used for some applications. A fluid powered tool is preferred over an electrically powered tool for many applications due to the explosive hazards associated within the well. Also, the tool is preferably arranged so that the cylinder 28 is retracted to assemble the guide on the rod, but in other embodiments the cylinder could be normally retracted and then extended to assemble the guide on the rod. The latter alternative may require more vertical space for the installation tool, which is generally undesirable.

In a preferred embodiment, the horizontal rail for guiding lateral movement of the table comprises a first rail and a second rail, with the rails being spaced apart for guiding lateral movement of the table between the first, second and third positions. Also, a vertical guide for guiding vertical movement of the bottom plate preferably comprises a plurality of spaced apart vertical rails, so that the bottom plate moves uniformly upward as it is guided by the plurality of vertical rails when the cylinder is activated. FIG. 4 illustrates two centrally located rails 30 each with a linear bearing 45 for guiding movement of bottom plate 42 and connecting plate 44, and a plurality, e.g., four, additional vertical rails 31, with two rails being outward of cylinder 28 and two rails being opposite the cylinder 28 with respect to rails 30.

For the embodiment shown herein, the bottom plate is moved upward by the cylinder while the top plate remains stationary. In other embodiments, the top plate could be moved downward to compress the rod guide against the bottom plate and thereby assemble the guide on the rod. In still other embodiments, both the top plate and the bottom plate may be movable with respect to the frame to assemble the guide on the rod. The lever 22 is depicted exiting the side of the assembly. In other cases, the lever 22 may exit the top of the assembly, and may serve the same purpose.

In the intermediate position, the tag plate or bottom plate functions as a stop to prevent downward movement of the rod guide. When in this intermediate position, the top plate has a sufficiently wide slot so that the rod guide may pass through the top plate to allow the rod guide to engage the bottom plate. When the table is moved to the active or third position, each of the top plate and the bottom plate preferably includes a frustoconical surface to engage a portion of the rod guide, and at least one of these plates is movable axially in response to actuation of the cylinder to move the plates closer together, thereby compressing the two portions of the guide and assembling the guide on the sucker rod.

The powered tool disclosed herein is well suited for use at a well site to install guides as a rod is run into a well, but may also be used in a shop to install guides on sucker rods which are then shipped to a well site. In the latter case, the tool is preferably turned 90° so that the rod is generally horizontal when the guides are installed in the rods. Also, the hydraulic action of positioning the guide halves axially together to install the guide on a rod may be reversed so that guide halves are pressed axially apart to remove the guide from the rods.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A fluid powered tool for assembling a two-piece guide on a sucker rod at a well site, comprising:

a table laterally movable with respect to the sucker rod, the table supporting a fluid powered cylinder, a bottom plate for engaging the rod guide, a top plate for engaging the rod guide, and a vertical guide for guiding vertical movement of one or more of the bottom plate and the top plate;

a horizontal rail for guiding lateral movement of the table;

the bottom plate including a recess for receiving the sucker rod when the guide engages the bottom plate;

the top plate including a recess for receiving the sucker rod when the guide engages the top plate; and a fluid powered cylinder moves the bottom plate with respect to the top plate to assemble the guide on the rod.

2. The fluid powered tool as defined in claim 1, wherein the table is laterally movable in response to movement of a lever.

3. The fluid powered tool as defined in claim 1, wherein the table is enclosed within a frame.

4. The fluid powered cylinder as defined in claim 1, wherein the horizontal rail for guiding lateral movement of the table includes first and second spaced apart rails each for guiding lateral movement of the table.

5. The fluid powered cylinder as defined in claim 1, wherein the vertical guide for guiding vertical movement of one or more of the bottom plate and the top plate includes a plurality of spaced apart vertical guides for guiding vertical movement of one or more of the bottom plate and the top plate.

6. The fluid powered cylinder as defined in claim 1, wherein the recess in the top plate has a frustoconical configuration.

7. The fluid powered cylinder as defined in claim 1, wherein the recess in the bottom plate has a frustoconical configuration.

8. A fluid powered tool for assembling a two-piece guide on a sucker rod at a well site, comprising:

a table laterally movable with respect to the sucker rod, the table supporting a fluid powered cylinder, a bottom plate for engaging the rod guide, a top plate for engaging the rod guide, and a vertical guide including at least one vertical guide for guiding vertical movement of one or more of the bottom plate and the top plate;

at least one horizontal rail for guiding lateral movement of the table;

the bottom plate including a recess for receiving the sucker rod when the guide engages the bottom plate;

the top plate including a recess for receiving the sucker rod when the guide engages the top plate;

a frame at least substantially enclosing the table; and a fluid powered cylinder moves the bottom plate with respect to the top plate to assemble the guide on the rod.

9. The fluid powered tool as defined in claim 8, wherein the table is laterally movable in response to movement of a lever.

10. The fluid powered cylinder as defined in claim 8, wherein the at least one horizontal rail for guiding lateral movement of the table includes first and second spaced apart rails each for guiding lateral movement of the table.

11. The fluid powered cylinder as defined in claim 8, wherein the at least one vertical guide includes a plurality of spaced apart vertical guides for guiding vertical movement of one or more of the bottom plate and the top plate.

12. The fluid powered cylinder as defined in claim 8, wherein the recess in the top plate has a frustoconical configuration.

13. The fluid powered cylinder as defined in claim 8, wherein the recess in the bottom plate has a frustoconical configuration.

14. A method of assembling a two piece guide on a sucker rod at a well site, comprising:

supporting a fluid powered cylinder, a bottom plate, a top plate, and a vertical guide on a laterally movable table;

guiding lateral movement of the table on one or more horizontal rails;

providing a recess on the bottom plate for receiving a sucker rod when the guide engages the bottom plate;

providing a recess in the top plate for receiving the sucker rod when the guide engages the top plate; and powering a cylinder to move the bottom plate with respect to the top plate to assemble the guide on the rod.

15. The method as defined in claim 14, wherein the table is laterally movable from the first inactive position to a second intermediate position and to a third active position, the rod guide engaging the bottom plate when in the second position, and each of the top plate and the bottom plate engaging the guide when the table is in the third active position.

16. The method as defined in claim 14, further comprising: moving a lever to laterally move the table.

17. The method as defined in claim 14, further comprising: enclosing the table within a frame.

18. The method as defined in claim 14, wherein the vertical guide for guiding vertical movement of one or more of the bottom plate and the top plate includes a plurality of spaced apart vertical guides for guiding vertical movement of one or more of the bottom plate and the top plate.

19. The method as defined in claim 14, wherein the recess in the top plate has a frustoconical configuration.

20. The method as defined in claim 14, wherein the recess in the bottom plate has a frustoconical configuration.

* * * * *